United States Patent [19]

Carlsson et al.

[11] 4,073,450

[45] Feb. 14, 1978

[54] DEVICE FOR HOLDING YARN BOBBINS

[75] Inventors: Eric Carlsson; Karl Ivan Gefvert; Thomas Hjalmarsson; Anton Kerff; Karel Pejchal; Lars Wide, all of Ulricehamn, Sweden

[73] Assignee: Aktiebolaget IRO, Ulricehamn, Sweden

[21] Appl. No.: 723,196

[22] Filed: Sept. 14, 1976

[30] Foreign Application Priority Data

Sept. 15, 1975 Germany ..... 2541051
May 21, 1976 Germany ..... 2622989

[51] Int. Cl.[2] ..... B65H 49/02; D02H 1/00; D03J 5/08

[52] U.S. Cl. ..... 242/131

[58] Field of Search ..... 242/35.5 R, 35.5 A, 242/130, 131, 131.1; 28/35, 34; 66/125 R

[56] References Cited

U.S. PATENT DOCUMENTS

| | | | |
|---|---|---|---|
| 2,063,752 | 12/1936 | Peterson | 242/131.1 |
| 2,172,850 | 9/1939 | Peterson et al. | 28/35 |
| 2,429,798 | 10/1947 | Bradnack et al. | 242/131 |
| 2,844,335 | 7/1958 | Freeze | 242/131.1 |
| 3,773,274 | 11/1973 | Wildi | 242/131.1 |

*Primary Examiner*—Leonard D. Christian
*Attorney, Agent, or Firm*—Blanchard, Flynn, Thiel, Boutell & Tanis

[57] ABSTRACT

A transport device is provided which is driven by an electromotor and on which more than two bobbin supports are mounted and are movable in common such that the respective bobbin to be unwound can be brought into the required association with respect to a stationary thread eye. A thread scanning device is provided adjacent the unwound thread for detecting the thread as it jumps from the bobbin just emptied to the next bobbin. This thread scanning device is connected with the electromotor such that, when the thread scanning device responds, the motor moves the transport device to such an extent that the next bobbin is brought into the required association with respect to the stationary thread eye.

20 Claims, 13 Drawing Figures

DEVICE FOR HOLDING YARN BOBBINS

FIELD OF THE INVENTION

This invention relates to a device for holding yarn bobbins, wherein more than two bobbin supports are provided each for holding one bobbin, whose thread ends are tied together to permit them to unwind in succession without interruption, and wherein a stationary thread eye has a specific association with respect to the bobbin which is unwinding at any given moment.

BACKGROUND OF THE INVENTION

In the case of textile machines, for example weaving or knitting machines, the thread to be processed must be supplied as continuously as possible, i.e. without interruption, in order to prevent irregularities in the textile goods to be produced. To this end use is made of holding devices for holding the yarn bobbins on which two yarn bobbins are normally mounted whose thread ends are knotted together. If one bobbin is empty, thread is unwound from the next bobbin without interruption. While the thread is being withdrawn from this bobbin, the following bobbin can be mounted and the start of the thread from this bobbin tied with the end of the thread from the bobbin which is presently in use. In such holding devices, there is usually provided a stationary thread eye through which the unwound thread is conducted in order to facilitate unwinding and to maintain a constant thread unwinding force. Moreover, a thread brake can also be provided in front of said thread eye so that the textile machine is supplied with the thread under a tension which is always constant and adjustable. In order to maintain the same amount of tension in the unwound thread prior to and after exchanging the yarn bobbin, the thread eye or the thread brake must always be supplied with the thread from the yarn bobbin in the same respective direction.

Such a holding device is already known from U.S. Pat. No. 3,773,274. This device has a frame part on which a plurality of pairs of bobbin supports are secured. Each pair of bobbin supports is associated with two stationary thread eyes with interposed thread brakes. The bobbin supports are secured to the frame such that the bobbins mounted thereupon are aligned at equal angles with respect to the thread eye associated therewith so that the thread eye is always supplied with the thread from the other bobbin in the same direction after the first bobbin has been emptied. The two bobbin supports of one bobbin support pair can be tipped outwardly in order to be able to substitute a new bobbin for the spent one respectively, while thread is unwound from that bobbin of a pair of bobbins which is not yet empty.

U.S. Pat. No. 2,429,798 discloses another holding device of this type in which two yarn bobbins are secured on a frame in a juxtaposed, inverted position. In the area between the two bobbins a pivotal arm is supported with a thread eye attached at one end. The thread eye is positioned in exact axial alignment with respect to the yarn bobbins in the two end positions of this arm. As soon as the one yarn bobbin is emptied and thread is removed from the other yarn bobbin, the arm pivots from its one end position into the other and thus ensures that the thread eye is respectively positioned in axial alignment of the respective yarn bobbin. While thread is unwound from the new yarn bobbin, the emptied yarn bobbin can be exchanged for a full one.

The two holding devices described above are disadvantageous in that only two yarn bobbins can be stored simultaneously. Thus, immediately after one yarn bobbin has been completely unwound, a new bobbin must be mounted. This results in an undesirable, excessive workload on the operating personnel in the case of small yarn bobbins and/or in the case of large yarn consumption by the textile machine.

The object of the present invention is to provide a holding device of the type stated at the outset in which more than one yarn bobbin can be stored and in which the completely unwound yarn bobbin is exchanged automatically for the next available yarn bobbin.

This object is accomplished in accordance with the instant invention in that a transport device is provided which is driven by an electromotor and on which more than two bobbin supports are mounted and are movable in common such that the respective bobbin to be unwound can be brought into the required association with respect to the stationary thread eye, that a thread scanning device is provided adjacent the unwound thread for detecting the thread as it jumps from the bobbin just emptied to the next bobbin, that this thread scanning device is connected with the electromotor such that, when the thread scanning device responds, the motor moves the transport device to such an extent that the next bobbin is brought into the required association with respect to the stationary thread eye.

In the holding device of this invention, more than two bobbins can be stored simultaneously and are automatically brought in succession to a location in front of the stationary thread eye which is associated therewith. A thread scanning device which is usually located directly adjacent the stationary thread eye responds to the thread when it jumps from the just emptied bobbin to the next bobbin and energizes an electromotor which drives a transport device to which all bobbins are attached and moved in common by said transport device. As soon as the new bobbin has assumed its exactly aligned position in front of the stationary thread eye, the electromotor is de-engerized and the transport device stopped. With the aid of such a holding device it is possible to supply the textile machine with the required yarn supply for a longer period of time, for instance through a whole day, and no operating personnel has to be available any longer after each bobbin change.

In an advantageous further development, the thread segment between two successive bobbins is respectively conducted through at least one clamping member which retains it until it is released when the unwinding thread jumps to the successive bobbin, and the clamping member is secured to a support which is mounted on the transport means approximately parallel to the bobbin axis in a fixed spaced relation from the bobbin support. The clamping member subdivides the free length of the thread segment into two considerably shorter free portions which are substantially insensitive to an air draft. Furthermore, the subdivision of the area to be bridged makes it possible for the operating personnel to better estimate the necessary length of the segment for operation without tension, but not too loose, The spacing of the support, including the clamping member, from the bobbin support on the transport means results in that the change in spacing which occurs at points of curvature or reversal are also subdivided as well, i.e., the spacing from the preceding bobbin to the clamping member and from the clamping member to the subsequent bobbin varies independently of one another by such a small amount that the temporary loosening is confined to magnitudes which are not dangerous. Due to the points of curvature of reversal of the transport means, the clamping member cannot be mounted on a frame disposed on a bobbin support as, for example, the frame of the main support arm which supports the thread eye, since this frame pivots outwardly at the points of reversal and would thus enlarge instead of reduce the area to be bridged by the thread segment, thus producing tension. In view of the low clamping action of the clamping member which is provided, the thread segment would be ripped out of this clamping member altogether and would hang completely free along the rest of the transport path. The clamping member has a clamping effect which is dimensioned to be so slight that the continuous thread supply is not impeded, since the unwinding tension acting on the hitherto resting thread segment without tension while the preceding bobbin is unwound is sufficient to withdraw the thread segment out of the clamping member without a tug. The slight clamping action is completely sufficient for holding the resting segment without tension.

A control element is advantageously disposed on the support to keep its orientation with respect to the bobbin axis constant and to prevent changes of thread direction adjacent the clamping member at the points of curvature and reversal, thus eliminating undesirable tension and/or friction.

In a preferred embodiment, a support arm for the thread eye is secured to the support of the clamping member. An additional mount for the thread eye can thus be omitted. The rigid association between the bobbin support and the support for the clamping member ensures an identical association of the thread eye relative to the bobbin axis.

The constant orientation of the support is ensured advantageously in that the support is disposed to be rotatable about its axis relative to its amount on the transport means and is firmly connected with a control bar mounted on the bobbin support to be rotatable and longitudinally displaceable. The control bar follows the direction of the transport means in the case of rectilinear movement. In the case of curves or points of reversal, it pivots automatically into a position corresponding to the respective arc chord. In this way, the same side of the support remains facing the thread bobbin. The same applies to the clamping member and the support arm. The longitudinal displaceability of the control bar, advantageously accomplished in a simple manner by means of an elongated hole on the control bar, facilitates the adaptation to the direct distance between the support and the bobbin axis which is reduced at the points of curvature and reversal. The thread eye supported by the support arm is advantageously designed as an elongated loop for the same reason.

In a preferred embodiment, a plurality of elastic clamping members are provided. The free areas of the thread segment are reduced advantageously in this way. Moreover, it is possible in this manner to bridge the difference in height between the lower end of the preceding and the thread eye of the successive bobbin instead of by means of a diagonal path of the thread segment or at least one portion of these areas formed by the clamping member. It is also possible to conduct the thread segment at such an angle that it passes along the device elements and across free spacings as short as possible.

A clamping member is favorably located on the support approximately flush with the lower bobbin rim and a clamping member is positioned approximately in the plane of the thread eye so that the thread segment extends from the lower area of the preceding bobbin at first close to the control bar and then approximately perpendicular thereto along the support and finally approximately parallel to the transport means freely to the upper area of the support and then to the thread eye of the successive bobbin.

DETAILED DESCRIPTION

Figure 2:
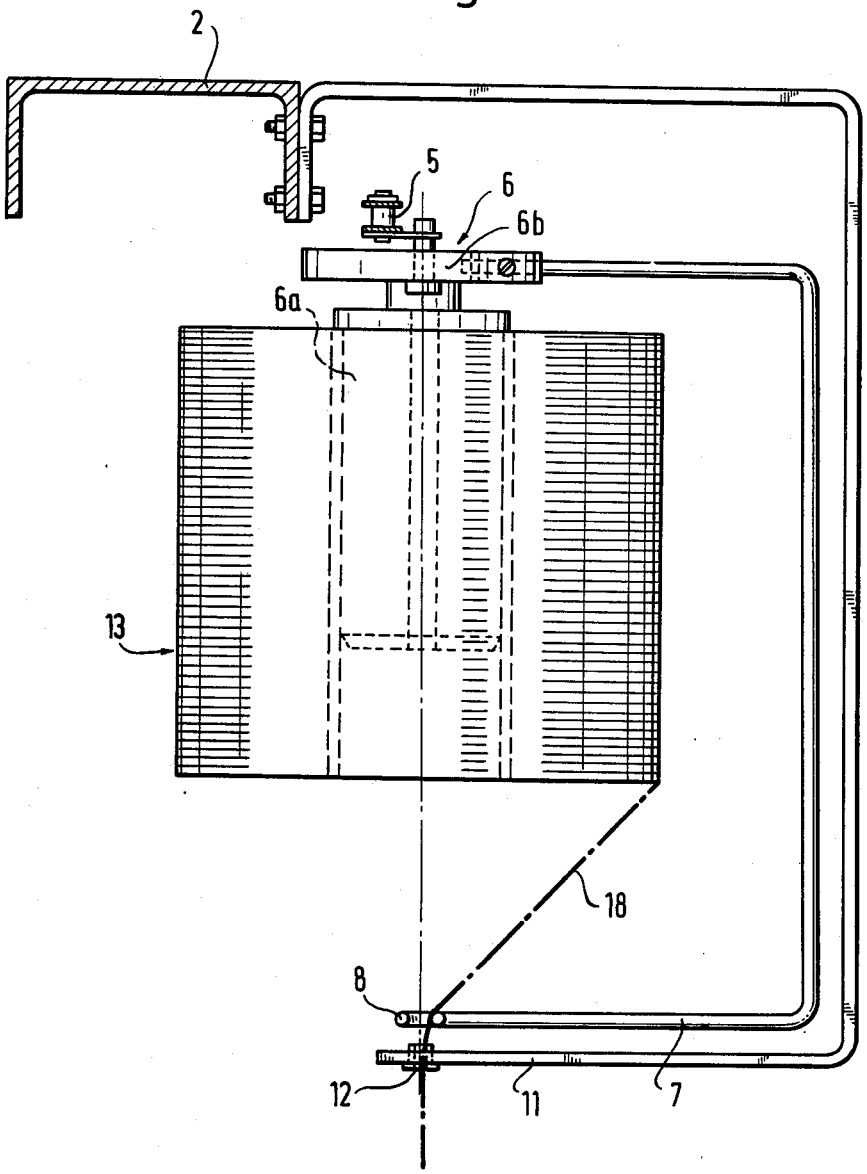
FIG. 2 is a sectional view taken along the line II—II in FIG. 1.

The illustrated holding device includes a table 1 on which a support 2 of U-shaped cross section is secured in a vertical direction. Sprockets 3 and 4 are mounted respectively at opposite ends of said support 2 in order to guide an endless chain 5. Individual bobbin supports 6 are arranged on the endless chain 5 in equally spaced relation and have a spreadable mounting cone 6*a* as shown in FIG. 2. A bobbin can be slid onto said cone and is friction-tight. These mounting cones 6*a* are connected respectively with the endless chain 5 via a base plate 6*b*. Moreover, a U-shaped bracket 7 which has a U-shaped thread eye 8 at its free end is secured to each bobbin support 6. The function of this bracket 7 will be explained in detail hereinbelow. A transmission 9 with an electromotor 10 mounted thereon is attached to the support 2 in the vicinity of the lower sprocket 4. A U-shaped holding bracket 11 projecting perpendicularly from the support 2 is secured thereto at one end and has a closed thread eye 12 at its free end. This thread eye can also be associated with a thread brake which is not shown in detail in the illustration.

A yarn bobbin 13*a*–13*i* can be mounted respectively on the mounting cones 6*a* of the individual bobbin supports 6. The ends of the thread of the first yarn bobbin 13*a* which is unwound as well as the successive bobbin are respectively knotted together with the starting end of the thread from the next successive yarn bobbin. The result is thus a coherent thread from the beginning of the first yarn bobbin 13*a* to the end of the last yarn bobbin 13*i*. The first yarn bobbin 13*a* to be unwound is the one which is axially aligned with respect to the stationary thread eye 12. The starting end of the thread from this yarn bobbin 13*a* is passed through the thread eye 12 and can be conducted from there to the textile machine.

Figure 3A:
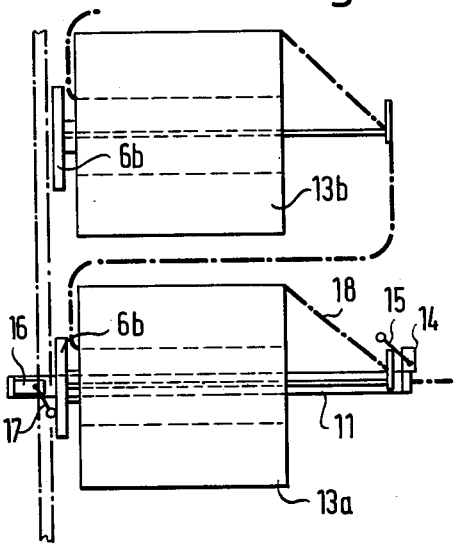
FIG. 3*a*–3*d* are four partial elevational views of the holding device according to FIG. 1 and illustrating different positions of two successive yarn bobbins.
Figure 3B:
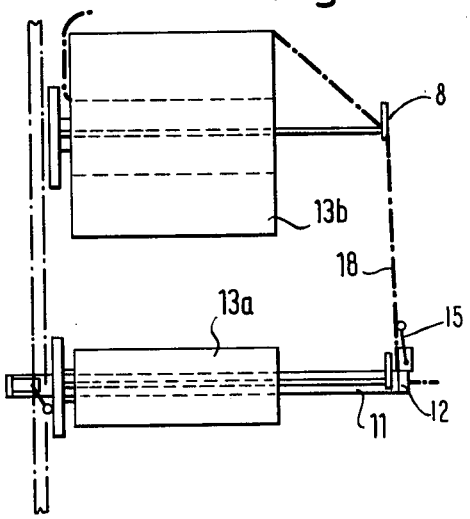
Figure 3C:
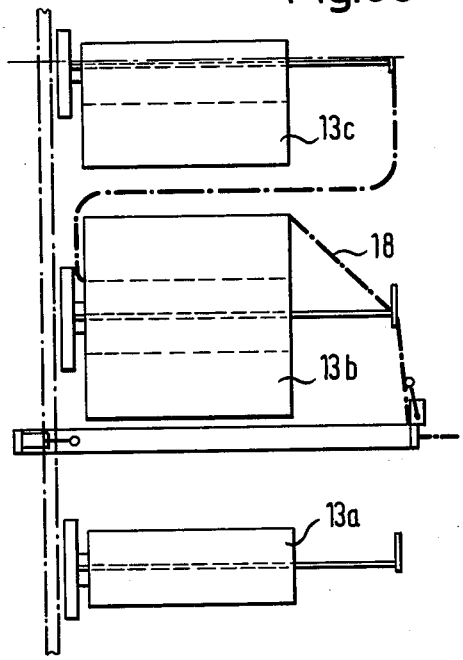
Figure 3D:
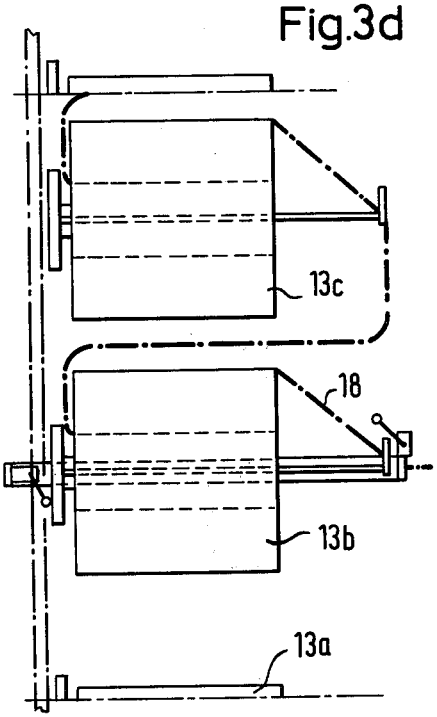
Figure 4:
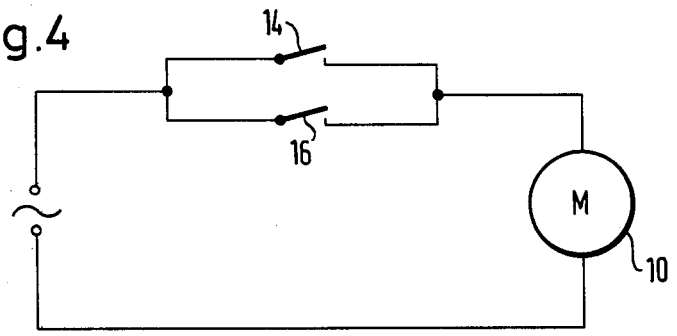
FIG. 4 is a block diagram for the motor control.
Figure 5:
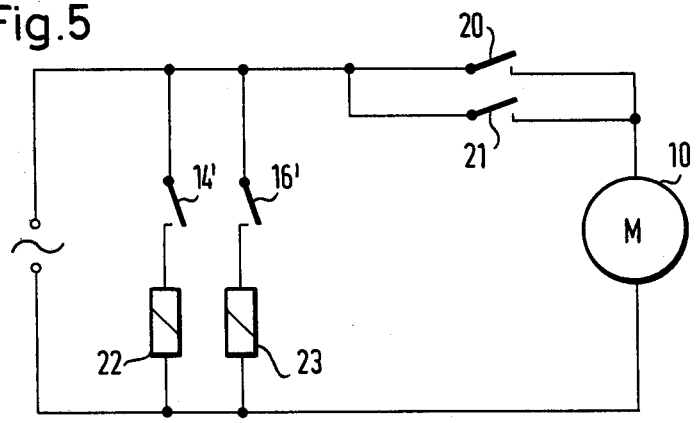
FIG. 5 is a modified block diagram for the motor control corresponding to the block diagram according to FIG. 4.
Figure 6:
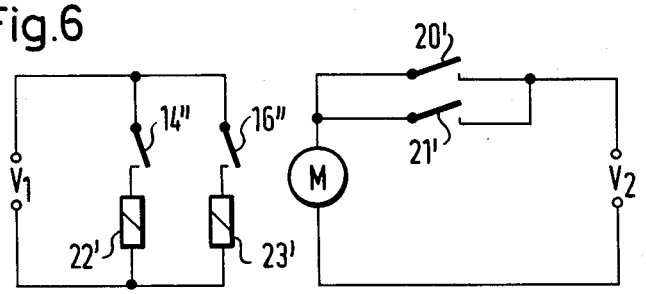
FIG. 6 is a modified block diagram for the motor control corresponding to the block diagram according to FIG. 5.
Figure 7:
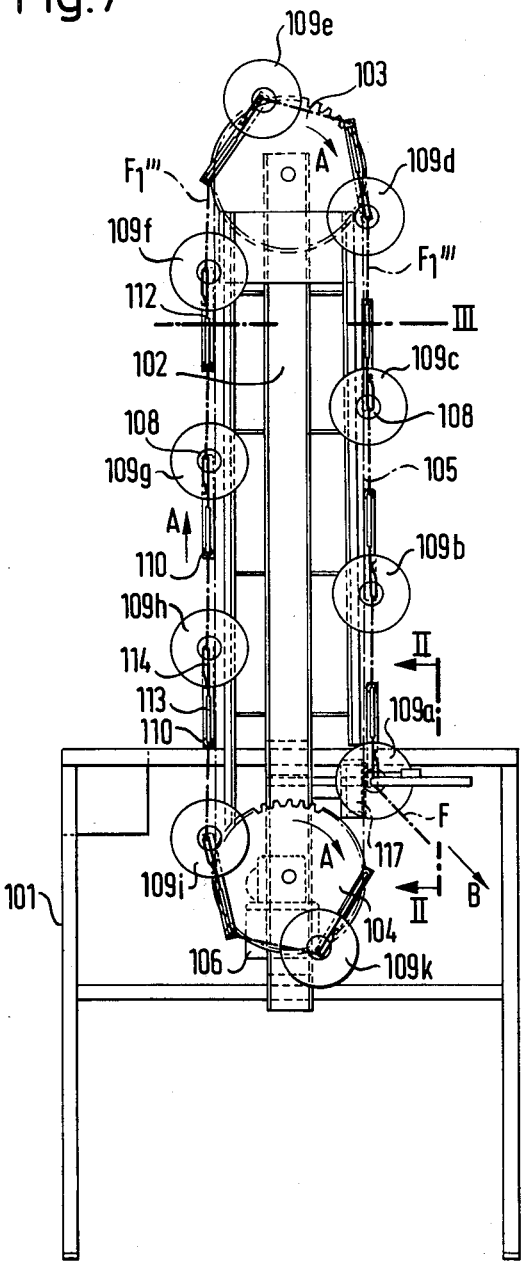
FIG. 7 is a schematic elevational view of another embodiment of a holding device for thread bobbins.

As is evident from FIG. 3*a*–13*d* an electric switch 14 is positioned on the holding bracket 11 immediately adjacent the thread eye 12 and has a switching arm 15. Another electric switch 16 with a switching arm 17 is secured on the support 2 in a housing 16*a* such that its switching arm 17 projects into the path of movement of the bobbin support 6. These two switches 14 and 16 are part of an electrical circuit arrangement as is illustrated in FIGS. 4–6. According to the embodiment of FIG. 4, the two switches 14 and 16 are connected in parallel and constitute the drive circuit of the electromotor 10.

The example of the wiring according to FIG. 5 merely constitutes a variation of this principal block diagram according to FIG. 4, since relay switches 20 and 21 are provided in the supply circuit of the motor instead of switches 14 and 16. The two switches 14' and 16' corresponding to switches 14 and 16 are connected in series with a relay 22 or 23 and in parallel with the operational voltage terminals. Relay 22 is associated with relay switch 20 and relay 23 with relay switch 21. The function of these two switching arrangements is as follows. The motor 10 is supplied with current anytime and as long as one or both of the two switches 14 or 16 (14' or 16') are closed. If both switches 14 and 16 are opened, the motor 10 is disconnected from the input voltage and stands still. The other switching variation illustrated in FIG. 6 differs from that in FIG. 5 in that the switches 14'' and 16'' and relays 22', 23' corresponding to switches 14' and 16' and relays 22, 23 are driven with a lower voltage $V_1$ than the voltage $V_2$ for the motor. This is advantageous in that microswitches can be employed which are more suitable and in that the circuit complies with stringent accident prevention regulations.

OPERATION

Figure 1:
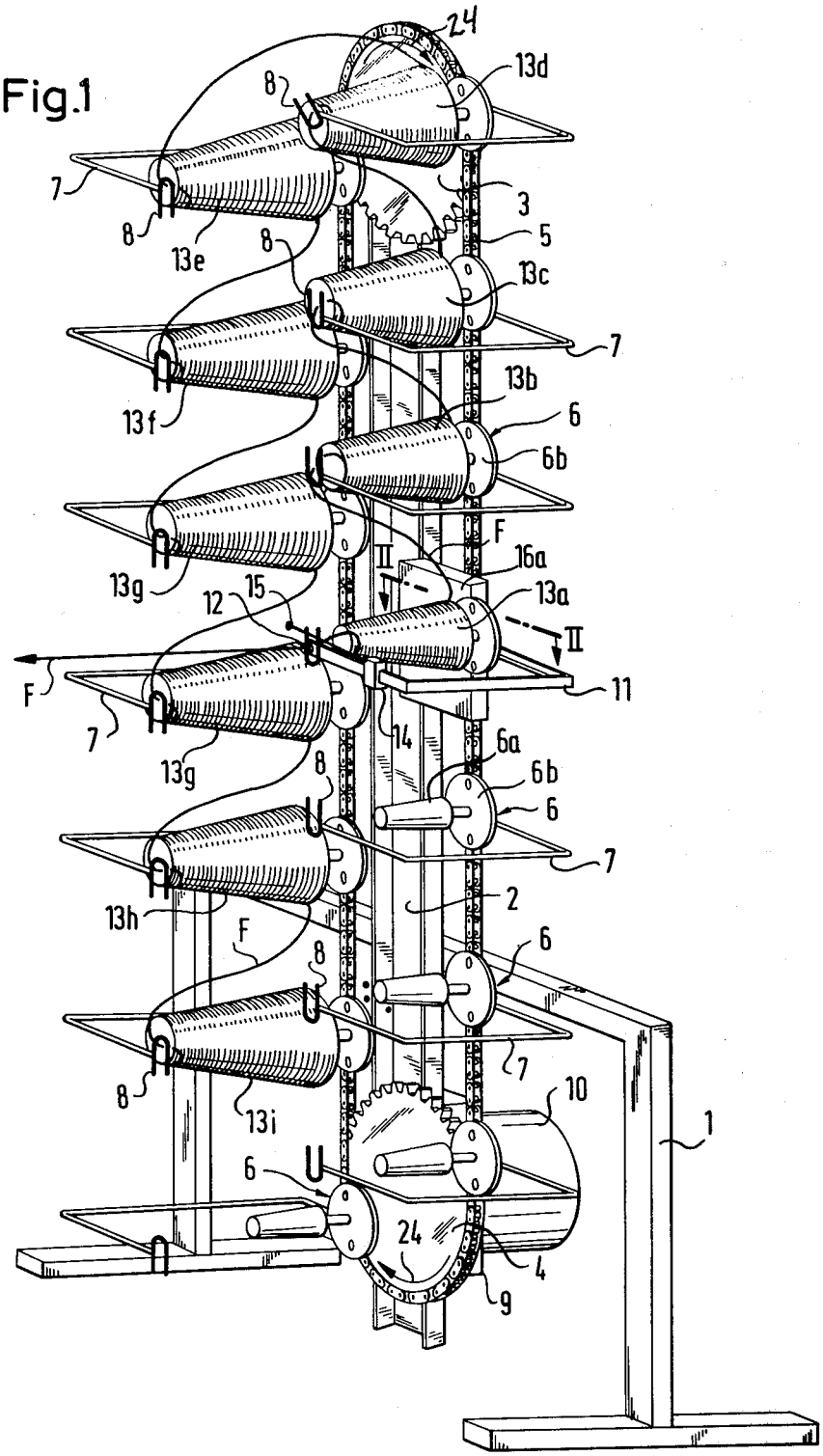
FIG. 1 is a perspective elevation of a holding device in accordance with the invention.

The mode of operation of the recited holding device is as follows. A yarn bobbin 13 is respectively mounted on the individual mounting cone 6*a* of adjacent or of all bobbin supports 6. The starting end of the thread of the first yarn bobbin 13*a* adjacent the holding bracket 11 is conducted outwardly through the stationary thread eye 12. The discharge end of the thread from this first yarn bobbin 13*a* is knotted together with the start of the thread from the next adjacent yarn bobbin 13*b*. The end of the thread from this adjacent yarn bobbin 13*b* is knotted with the beginning of the thread from the next bobbin 13*c* etc, thereby producing an uninterrupted thread F which begins with the starting end of the thread from the first yarn bobbin 13*a* and extends to the end of the last yarn bobbin 13*i*. The portions of the thread located between two successive yarn bobbins, e.g. 13*a* and 13*b*, are respectively placed in the unlaterally open thread eye 8 of the bracket 7. If the first yarn bobbin 13*a* is not already positioned in precise axial alignment relative to the stationary thread eye 12, it must be adjusted to this basic position which can be accomplished by manually driving the endless chain 5 or by briefly energizing the motor 10. The thread portion conducted through the stationary thread eye 12 can be inserted in the textile machine. The electrical circuit of the holding device can now be energized with voltage. In the basic position illustrated, the two switches 14 and 16 or 14', 16', 14'', 16'' are open as is shown in FIG. 4 – 6 so that the motor is deenergized. Thread can now be unwound. In the illustrated embodiment, the thread withdrawn from the first yarn bobbin 13*a* leaves this bobbin over the top. This basic position is illustrated with the essential parts in FIG. 3. In this basic position, the switching arm 15 of the switch 14 is in its first switching position. The switching arm 15 is located outside the area of movement of the thread segment 18 between the stationary thread eye 12 and the circumference of the yarn bobbin 13*a*. The switching arm 17 of the switch 16 abuts on the base plate 6*b* of the bobbin support 6 in its first position in this basic position. If the first yarn bobbin 13*a* has been unwound completely, the thread segment 18 jumps upwardly and forms a straight connection between the stationary thread eye 12 and the adjacent movable thread eye 8 as shown in FIG. 3b. The thread segment 18 thus enters the area of the switching arm 15 of the switch 14 and moves it into its second switching position in which the switch 14 is closed. The motor 10 is thus supplied with current via switch 14 and drives the sprocket 4 as well as the endless chain 5 in the direction of the arrow 24 (FIG. 1). The empty yarn bobbin 13*a* is removed downwardly as indicated in detail in FIG. 3*c*, whereby the switching arm 17 of the switch 16 is moved into its second switching position and closes switch 16. As the downward movement of the next full bobbin 13*b* continues, the switching arm 15 of the switch 14 again moves into its first position and the switch 14 is again opened. This is done because the thread segment 18 assumes an ever increasing inclination due to the fact that the thread eye 8 is somewhat closer to the yarn bobbin 13 than the stationary thread eye 12. Thus, the switch 14 is again opened, while switch 16 is still closed.

The movement of the endless chain 5 is continued until the switch 16 is opened again which is the case when the base plate 6*b* of the bobbin support 6 carrying the next full bobbin 13*b* moves into the area of movement of the switching arm 17 of switch 16 and moves it into its first switching position. The motor 10 is now de-energized and the next full yarn bobbin 13*b* is located in the desired basic position in which it is aligned axially relative to the thread eye 12. This condition is illustrated in FIG. 3*d* and corresponds to the condition according to FIG. 3*a*. The movable thread eye 8 associated with the bobbin support 6 is always disengaged from the thread automatically as soon as the bobbin support 6 leaves the basic position in a downward direction. If the yarn bobbin 13*b* located in the basic position is completely emptied, the travel cycle commences once again until the last yarn bobbin 13*i* has also passed through the basic position.

Optical scanning means may also be employed instead of the two switches 14 and 16. These normally consist of a source of light and a photosensor. In the present case, for example, the switch 14 could be replaced by an optical scanning means which responds when the thread segment 18 enters its scanning area. Likewise, such an optical scanning device or any other arbitrary scanning device could be substituted for switch 16. Of course, any other arbitrary switching arrangement which ensures a corresponding cycle of movement can be employed instead of the examples of the circuitry according to FIG. 4 – 6. In the course of microminiaturization, for example, a logic circuit arrangement could be employed which in the present case would merely have to consist of an OR-gate to which the two scanning means, switches 14 and 16 in this case, are connected on the input side. Of course, the transport device containing the endless chain can also be constructed in any other arbitrary manner, e.g. as a round plate with the individual bobbin supports arranged on the circumference thereof and which is rotated about its axis by a predetermined angular increment each time. In principle, the switch 16 can be omitted as well if there is a guarantee that the motor, after being energized, will move the transport device by only a predetermined specific increment and will then be de-activated automatically. The transport device does not have to be aligned vertically either. The individual bobbins can also be arranged in a horizontally extending plane. The vertical alignment of the transport device as illustrated is to be preferred to a horizontal arrangement because it is much more space-spacing.

MODIFICATION

The holding device illustrated in FIGS. 7–10 includes a table 101 which supports a vertically arranged support structure 102. Sprocket 103 and 104 are mounted respectively at the upper and lower regions of said support structure. An endless chain 105 is conducted about the two sprockets and is indicated only by a dot-and-dash line in FIGS. 7, 9 and 10. The sprocket 104 which forms the lower point of reveral for the endless chain 105 is coupled to a drive motor 106 which is mounted on the table 101 and which is indicated only schematically. The arrows A show the direction of rotation of the sprockets.

Bobbin supports 107 (FIG. 8) with mounting cones 108 for bobbins 109 are arranged in equally spaced relation on the endless chain 105. Each bobbin support 107 is associated with a support 110 which is mounted on the endless chain behind the bobbin support when seen in the direction of movement of said endless chain in a fixed spaced relation *a* from said bobbin support 107. The support 110 extends parallel to the bobbin axis and in the same direction as the mounting cone 108 thereof. It is mounted so as to be rotatable relative to the axis of the bearing member 111 secured to the endless chain 105. A control bar 112 is fixed adjacent the bearing member, the free end of said control bar being bifurcated and thereby forming an open elongated slot 112*a* which is adapted to allow the control bar 112 to surround the mounting cone 108 in a rotatable and longitudinally displaceable manner. A support arm 113 is mounted and supports a thread eye 114 at the end of the support 110 which is remote from the endless chain. The support arm 113 has two shanks which extend at right angles from one another. A short shank 113*a* is mounted in the tubular support 110, which is open at the top, by means of a tension spring 115. The shank 113*b* extends parallel to the control rod 112 in a direction toward the axis of the associated bobbin 109 so that the thread eye 114 overlaps the bobbin axis. The thread eye 114 is designed as in integrally bent loop (FIGS. 9 and 10), with the front portion thereof as located above the bobbin being closed in the direction of transport and the rearwardly bent free end thereof abutting elastically on the other position.

Three clamping members 116 are fastened on the support 110. One is located approximately at the same distance from the endless chain 105 as the lower end of the bobbin 109. Another is located approximately in the plane of the thread eye 114 and one is located therebetween. The clamping members 116 are designed as disc brakes.

Figure 8:
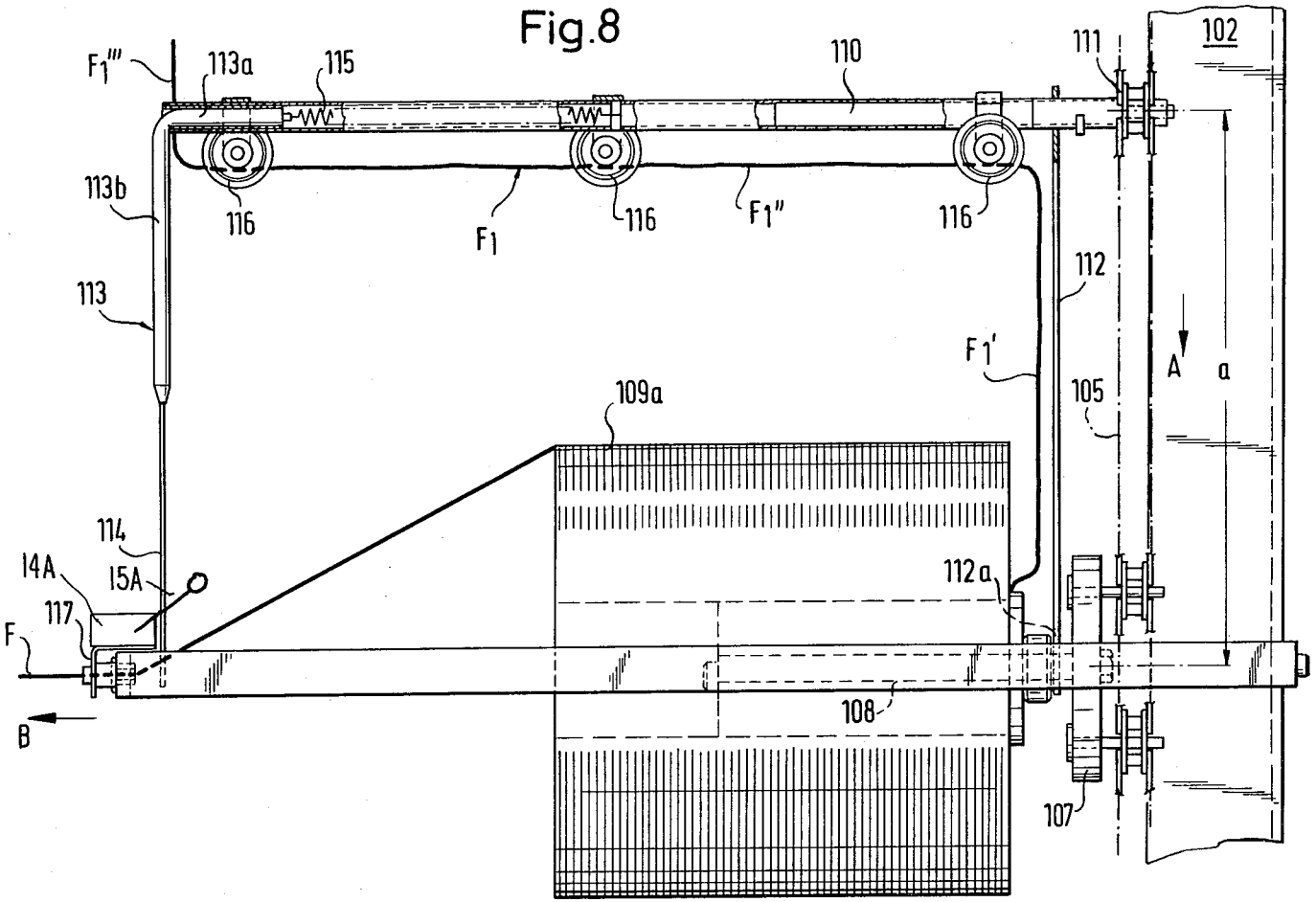
FIG. 8 is a schematic lateral elevation of the area designated II in FIG. 7.

A pay-out eye 117, which is mounted stationary on the table 101 and through which the thread issuing from the bobbin 109 is supplied to a processing station, is indicated schematically in FIG. 8.

The mode of operation of this holding device is as follows:

A bobbin 109 is respectively mounted on the bobbin supports 107. The end of the thread from each bobbin is knotted with the beginning of the thread on the bobbin next in line in the direction of transport A of the endless chain 105 so that a thread segment $F_1$ extends between two successive bobbins. All bobbins located on the holding device constitute a continuous thread storage whose beginning is the start of the bobbin 109*a* which is located in the position at the unwinding eye 117 indicated in FIG. 7 and 8. FIG. 8 illustrates how the thread F is removed from the bobbin 109*a* with a certain amount of removal tension in the direction of arrow B, finally passing through the thread eye 114. The thread segment between two successive bobbins, e.g. bobbins 109*a* and 109*b* (FIG. 7), which in its entirety is designated as $F_1$, initially extends in a partial segment $F_1'$ from the lower end of the bobbin 109*a* to the clamping member 116 located approximately at the same level, from here in a partial segment $F_1''$ approximately parallel to the support 110 through the clamping members located in the middle and approximately at the level of the thread eye and from there in a partial segment $F_1'''$ to the thread eye 114 of the following bobbin 109*b*, through which the section $F_2$ extends to the beginning of the bobbin 109*b*. The thread segment $F_1$ is not under tension, but is somewhat stretched in all partial segments $F_1'$, $F_1''$ and $F_1'''$. The thread thus does not have much freedom of movement and thus cannot become disorderly due to the action of external factors such as drafts. This relationship of length remain unchanged, even during the further transport of adjacent bobbins on the straight leg of the endless chain when a bobbin is empty and the next one is moved into the area of the unwinding eye 117.

Figure 9:
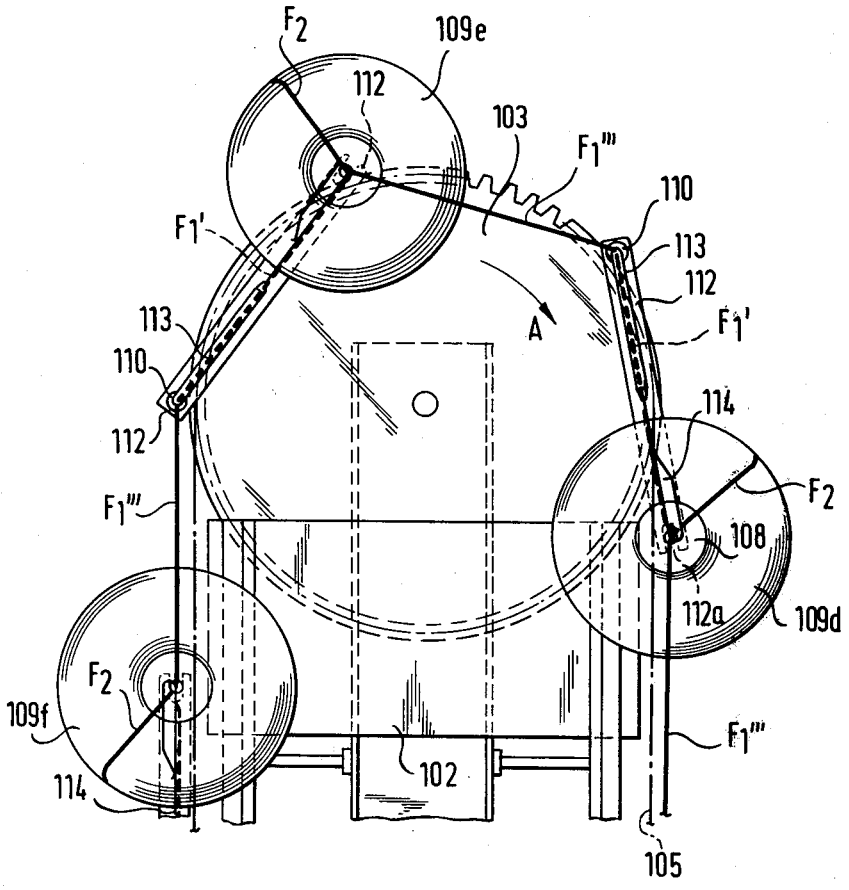
FIG. 9 is an enlargement of a part of FIG. 7.
Figure 10:
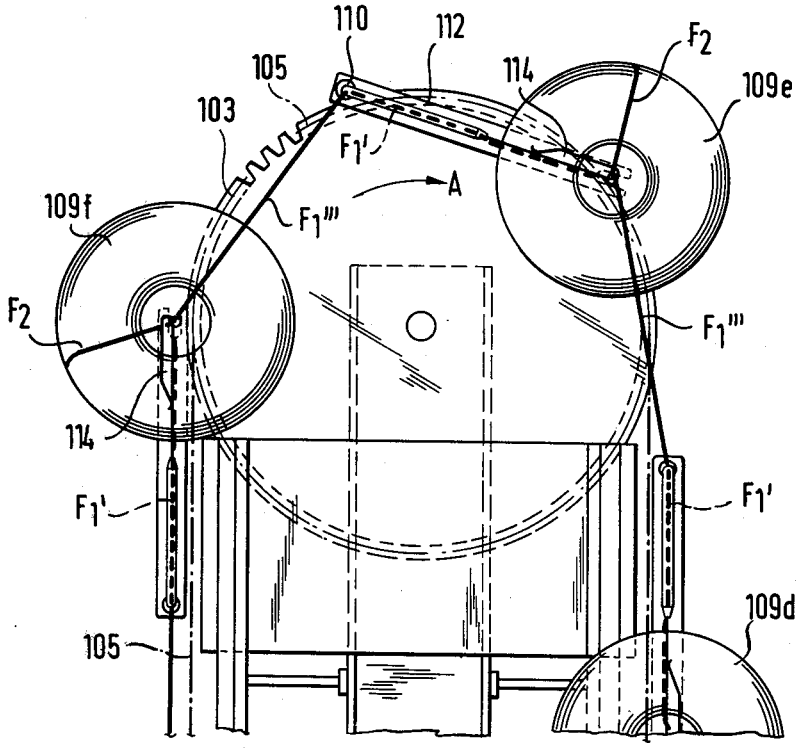
FIG. 10 corresponds to FIG. 9 but shows the holding device in another operative position.

FIGS. 9 and 10 show the spacing in the area of the point of reversal on the sprocket 103. The endless chain 105 on which the spacing between two bobbin supports as well as the spacing of each support 110 with respect to the associated bobbin is established, passes through a circular arc corresponding to the circumference of the sprocket. The rigid control bar 112, with one end rigidly attached to the support 110 and rotatable therewith relative to the endless chain 105, and with its elongated slot 112*a* at the other end surrounding the mounting cone 108 of the bobbin support 107, automatically angularly adjusts itself in all cases to the direction of the chord between the bobbin axis and the axis of said support 110 so as to maintain the thread eye 114 aligned with the respective bobbin axis. This chord distance is shorter than the arc so that there is longitudinal displacement of the control rod 112 relative to the mounting cone 108, as permitted by slot 112*a*, and a corresponding parallel displacement of the thread eye 114 relative to the bobbin axis. The longitudinal change is greatest when both the bobbin support 107 as well as the bearing member 111 for the support 110 are located on the circular path of the sprocket. This change in length then corresponds to the ratio of a chord to the associated arc. The thread segments $F_1'$ and $F_1'''$ becomes somewhat looser, but stretch again without tension as soon as the respective bobbins again reach the area of the straight leg of the chain. FIGS. 9 and 10 also show the bobbins 109*d*, 109*e* and 109*f* in two different positions in the area of chain reversal.

The thread is withdrawn through the stationary thread eye 117 initially from the bobbin 109*a* adjacent thereto. As soon as the bobbin 109*a* is empty, the unwinding tension first acts on the segment $F_1'$ of the thread segment $F_1$ leading to the following bobbin 109*b*. The clamping action of the clamping members 116 is adjusted to be so slight that it holds the loose thread, even when acted upon by a draft of air or the like, but nevertheless releases the thread when the thread tension comes into effect. The thread segment is thus pulled out of the three clamping members 116 in succession. More specifically, the thread segment $F_1$ is shortened due to the continuous withdrawal and is stretched, although only briefly, between the unwinding eye 117 and the clamping member 116 adjacent the endless chain, thereafter between the unwinding eye and the intermediate clamping member, then between the unwinding eye and the clamping member next to the support arm 113, and finally approximately straight between the thread eye 114 of the bobbin 109*a* and the thread 114 of the bobbin 109*b*. In this position, switching means 14A – 15A (FIG. 8) is actuated which in turn activates the drive motor in the same manner as the switch 14–15 as described with respect to FIGS. 1–6, whereby the endless chain and the transport means including the sprockets are moved until the bobbin 109*b* has reached the location at the unwinding eye 117. At this location, the motor is deactiated by a further switch which coacts with the transport device in the same manner as the switch 16–17 of FIGS. 1–6. As the bobbin 109*a* advances, the thread segment $F_1$ is pulled out of the associated thread eye 114 toward the rear thereof. While the thread on bobbin 109*b* and the following bobbins is being exhausted, a new bobbin can be substituted at the site of the empty bobbin 109*a*. The start of the thread must then be passed through the associated thread eye 114 and ties with the end of the thread of the bobbin 109*k*. The new thread segment $F_1$ thus formed between two bobbins must be placed in the clamping members of the support 110 associated with bobbin 109*k*.

The invention is not limited to this embodiment. The construction of the transport means can vary to a large extent. Likewise, the mounting of the bobbin support as well as the rotatable arrangement of the support for the clamping members on the transport means can also be accomplished in other ways. The same applies to the coupling by means of a control element which can be rotated and displaced longitudinally relative to the bobbin support.

Instead of three clamping members, a larger or smaller number of clamping members can be located on the support.

The design of the clamping members as disc brakes permits very exact adjustment of the clamping effect, but other forms of construction are also possible, however, for example forms corresponding to the thread eye 114.

It is also possible within the scope of the invention to connect the thread eye with the bobbin support independent of the support for the clamping members, for example by means of a U-shaped frame. The support with one or more clamping members is then positioned on the transport means irrespective of the thread eye.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a device for holding yarn bobbins and having at least two bobbin supports each for holding one bobbin, whose thread ends are tied together to permit them to unwind in succession without interruption, and a stationary thread eye which has a specific association with respect to the bobbin which is unwinding at any given moment, the improvement comprising a movable transport device on which more than two bobbin supports are mounted and are movable in common such that the respective bobbin to be unwound can be brought into an unwinding position having a required association with respect to the stationary thread eye, motor means connected to the transport device for moving same, and a thread scanning device provided adjacent the thread as unwound from the bobbin located in said unwinding position for detecting the thread as it jumps from the bobbin just emptied to the next bobbin, means connecting the thread scanning device with the motor means such that, when the thread scanning device detects the unwound thread jumping to the next bobbin, the motor means is energized to move the transport device to such an extent that the next bobbin is moved into the unwinding position so as to have the required association with respect to the stationary thread eye.

2. A holding device according to claim 1, wherein the transport device comprises an endless driving device on which said bobbin supports are mounted in predetermined, fixed spaced relation respectively.

3. A holding device according to claim 1, wherein a vertical upright support is provided for the transport device, wherein sprockets are secured to the upright support at the top and bottom respectively, and wherein said transport device includes an endless chain conducted about said sprockets, the bobbin supports being attached to the endless chain.

4. A holding device according to claim 3, wherein one of the sprockets is drivingly connected with the motor means via a transmission means.

5. A holding device according to claim 1, wherein a unilaterally open thread eye is provided on each bobbin support and is movable therewith in order to impart to the thread after it leaves the respective bobbin a defined path between the open thread eye and the next respective bobbin.

6. A holding device according to claim 5, wherein a bracket is arranged on each bobbin support to respectively surround a mounted bobbin in a U-shaped fashion, the bracket having its one end secured to the transport device, the bracket havings its other end provided with a U-shaped part which defines said open thread eye.

7. A holding device according to claim 1, wherein the thread scanning device comprises an electric switch having a switching arm which is disposed adjacent the stationary thread eye such that the switching arm is disengaged from the thread unwound from the bobbin located in the unwinding position, but is positioned in the area of the thread path between the stationary thread eye and the next bobbin after the thread has jumped from the emptied bobbin, and circuit means connected with the motor means and the switch such that said motor means is energized when the switch is actuated by the thread.

8. A holding device according to claim 1, wherein a bobbin support scanning device is provided for detecting when the next bobbin during its movement has reached the unwinding position associated with the stationary thread eye, the thread scanning device and the bobbin support scanning device both being operatively interconnected with the motor means such that the motor means is energized and remains energized until the bobbin support scanning device detects the movement of a bobbin into said unwinding position.

9. A holding device according to claim 8, wherein the means connecting the thread scanning device and the bobbin support scanning device to the motor means is a control circuit with an OR function, the motor means being energized when one of the two scanning devices is activated and not being de-energized until both of the scanning devices are de-activated.

10. A holding device according to claim 9, wherein the thread and bobbin support scanning devices both comprise electric switches which are connected in parallel and are located in the control circuit of the motor means and are open in the nonresponsive or de-activated state.

11. A holding device according to claim 1, wherein clamping means releasably hold the thread segment which extends between two successive bobbins, said clamping means releasing the thread segment when the unwinding thread jumps to the successive bobin, and support means mounted on the transport means approximately parallel to the bobbin axis in a fixed spaced relation from the bobbin support, said clamping means being secured to said support means.

12. A device according to claim 11, wherein a control element is disposed on the support means to keep its orientation with respect to the bobbin axis constant.

13. A device according to claim 11, wherein a support arm is secured to the support means, said support arm having a portion defining a thread eye.

14. A device according to claim 13, wherein the support means comprises an elongated support member which extends substantially parallel to the bobbin axis and is rotatably mounted on the transport device so as to be rotatable about its axis relative to its mount on the transport device, and a control bar fixedly connected at one end thereof to said support member and mounted at the other end thereof on the bobbin support so as to be rotatable and longitudinally displaceable relative thereto.

15. A device according to claim 14, wherein the support member, the support arm and the control bar surround the respective bobbin in a U-shaped fashion, the control bar projecting past one end of the bobbin and the support arm with the thread eye projecting past the other end of the bobbin.

16. A device according to claim 15, wherein the other end of said control bar has an elongated hole for receiving therein a part of the bobbin support.

17. A device according to claim 12, wherein the clamping means includes a first clamping member located on the support means approximately flush with the lower bobbin rim and a second clamping member positioned approximately in the plane of the thread eye.

18. A device according to claim 15, wherein the thread eye disposed at the free end of the support arm is designed as a loop which is closed at the front in the direction of transport and which has at its rear end elastically abutting end areas to permit release of the thread.

19. A device according to claim 17, wherein the clamping members are designed as disc brakes.

20. In a device for holding a plurality of yarn bobbins whose thread ends are tied together to permit them to unwind in succession without interruption, and a stationary thread eye having a specific positional relationship with respect to the bobbin which is being unwound at any given moment, the improvement comprising movable transport means defining an endless path of movement, a plurality of bobbin supports mounted on said transport means for movement therewith unidirectionally along said path, said plurality of bobbin supports including more than two bobbin supports, said bobbin supports being uniformly spaced apart along said path, drive means drivingly interconnected to said transport means for causing intermittent step-like movement thereof so that the bobbin supports containing thereon a thread-containing bobbin are sequentially moved into an unwinding position having a required association with respect to the stationary thread eye, first means for detecting the withdrawn thread as it jumps from a just-emptied bobbin as located at said unwinding position to the next bobbin, said first means causing activation of said drive means so that said transport means is moved whereby the next bobbin is moved into said unwinding position, and second means for sensing the movement of said next bobbin into said unwinding position and for de-energizing said drive means and stopping said transport means upon said next bobbin reaching said unwinding position.

* * * * *

UNITED STATES PATENT AND TRADEMARK OFFICE

CERTIFICATE OF CORRECTION

PATENT NO. : 4 073 450

DATED : February 14, 1978

INVENTOR(S) : Eric Carlsson; Karl Ivan Gefvert; Thomas Hjalmarsson; Anton Kerff; Karel Pejchal; Lars Wide It is certified that error appears in the above-identified patent and that said Letters Patent are hereby corrected as shown below:

Column 12, line 10; Change "Claim 12" to ---Claim 11---.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*